US007255119B2

(12) United States Patent
Lin et al.

(10) Patent No.: US 7,255,119 B2
(45) Date of Patent: Aug. 14, 2007

(54) SLIM SAFETY RUNNER AND MULTIPLE-FOLD UMBRELLA THEREOF

(75) Inventors: Chung-Kuang Lin, Taipei Hsien (TW); Jung-Jen Chang, Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 0 days.

(21) Appl. No.: 11/168,483

(22) Filed: Jun. 29, 2005

(65) Prior Publication Data

US 2007/0000530 A1 Jan. 4, 2007

(51) Int. Cl.
*A45B 25/08* (2006.01)

(52) U.S. Cl. ..... 135/38

(58) Field of Classification Search ..... 135/28, 135/38, 37, 39, 40, 41, 42
See application file for complete search history.

(56) References Cited

U.S. PATENT DOCUMENTS

| | | | | |
|---|---|---|---|---|
| 196,586 | A * | 10/1877 | Knapp | 135/41 |
| 1,513,655 | A * | 10/1924 | Turner | 135/25.33 |
| 2,136,569 | A * | 11/1938 | Trimpi | 135/41 |
| 3,156,249 | A * | 11/1964 | Biderman | 135/15.1 |
| 6,006,771 | A * | 12/1999 | Wu | 135/41 |
| 6,192,907 | B1 * | 2/2001 | Wu | 135/28 |
| 6,371,141 | B1 * | 4/2002 | Lin et al. | 135/28 |
| 6,394,115 | B1 * | 5/2002 | Tsun | 135/25.3 |
| 6,539,964 | B1 * | 4/2003 | Ko | 135/28 |
| 6,571,813 | B2 * | 6/2003 | Lin et al. | 135/28 |
| 6,810,895 | B2 * | 11/2004 | Lin et al. | 135/28 |
| 6,918,399 | B2 * | 7/2005 | Ko | 135/29 |
| 2002/0179130 | A1 * | 12/2002 | Ko | 135/39 |
| 2004/0011394 | A1 * | 1/2004 | Lin et al. | 135/28 |

* cited by examiner

*Primary Examiner*—David Dunn
*Assistant Examiner*—Noah Chandler Hawk
(74) *Attorney, Agent, or Firm*—Troxell Law Office, PLLC

(57) ABSTRACT

A slim safety umbrella runner includes a push button having a pivotal portion formed on a bottom portion of the push button and insertably engaged in a pivotal cavity formed in a bottom rim of the runner, with the push button pivotally biasing a resilient protrusion resiliently formed on a runner sleeve of an umbrella central shaft, whereby upon a depression of the push button to disengage the runner from the resilient protrusion, the runner will be lowered for closing the runner.

6 Claims, 4 Drawing Sheets

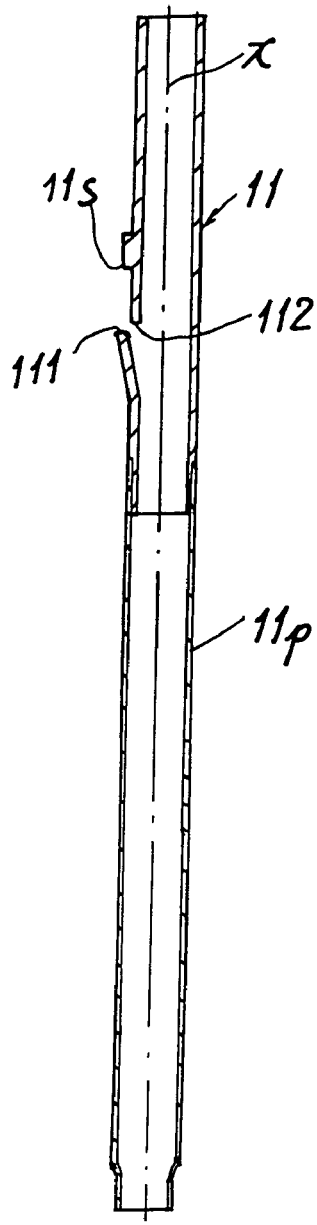
Fig. 7
Fig. 8
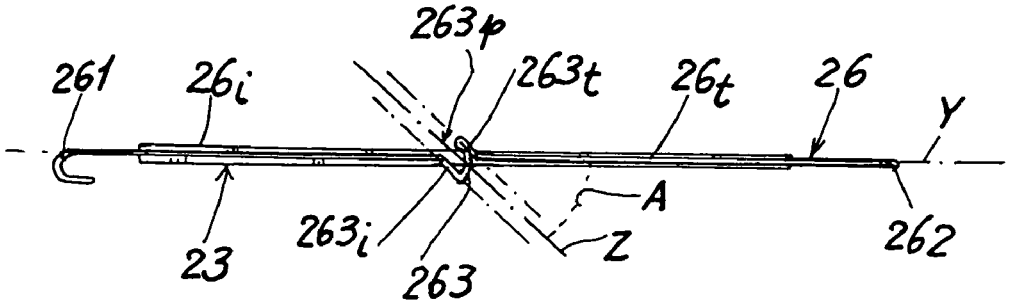

SLIM SAFETY RUNNER AND MULTIPLE-FOLD UMBRELLA THEREOF

BACKGROUND OF THE INVENTION

U.S. Pat. No. 6,371,141 invented by the same inventors of this application disclosed a safety umbrella runner including a push button slidably held in the umbrella runner for disengaging a catch resiliently formed in an umbrella shaft for closing the umbrella. The push button as slidably held in the runner requires an operating "stroke" for reciprocating a plunger (41) of the push button within the slot (33) formed in the runner, thereby increasing the volume of the runner to be unsuitable for making a slim multiple-fold umbrella.

The present inventors have found the drawbacks of the prior art and invented the present slim safety runner and the multiple-fold umbrella thereof.

SUMMARY OF THE INVENTION

The object of the present invention is to provide a slim safety umbrella runner including a push button having a pivotal portion formed on a bottom portion of the push button and insertably engaged in a pivotal cavity formed in a bottom rim of the runner, with the push button pivotally biasing a resilient protrusion resiliently formed on a runner sleeve of an umbrella central shaft, whereby upon a depression of the push button to disengage the runner from the resilient protrusion, the runner will be lowered for closing the runner.

Another object of the present invention is to provide a multiple-fold umbrella having the slim safety runner formed thereon for making a slim multiple-fold umbrella.

BRIEF DESCRIPTION OF THE DRAWINGS

FIG. 7 is a sectional drawing of the runner sleeve for slidably holding the safety runner thereon in accordance with the present invention.

FIG. 8 shows a U-shaped spring rib as slidably coupled with an intermediate rib of the present invention.

DETAILED DESCRIPTION

Figures 1, 2, 3:
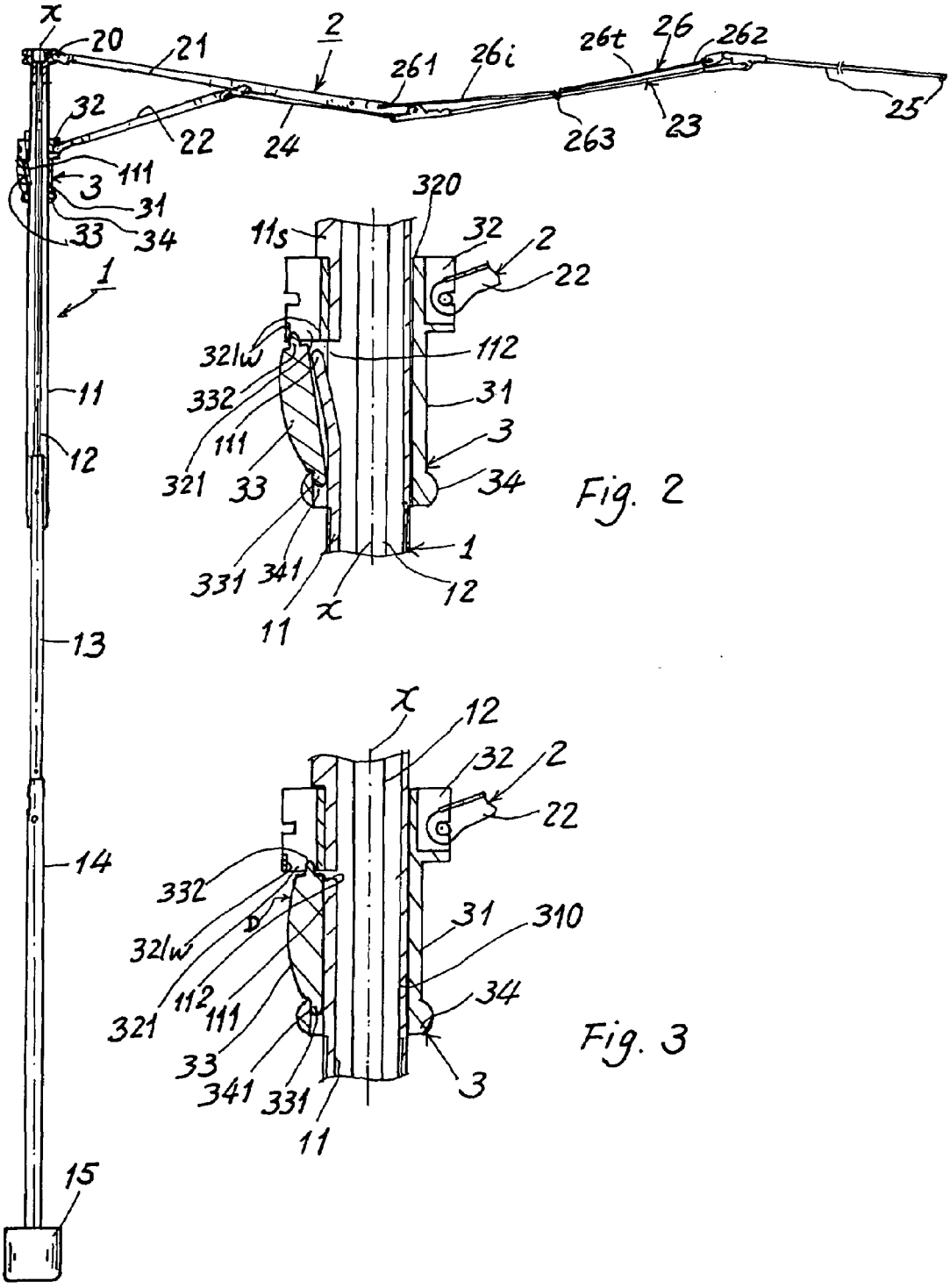
FIG. 1 shows an opened umbrella in accordance with the present invention.
FIG. 2 is an illustration showing the safety runner engaged with the resilient protrusion of the present invention when opening the umbrella.
FIG. 3 shows a depression (D) of the push button of the runner intended for closing the umbrella.

As shown in FIGS. 1~8, the present invention comprises a slim safety runner 3 and a multiple-fold umbrella having the slim safety runner 3 formed thereon.

The multiple-fold umbrella comprises: a central shaft 1 including a runner sleeve 11, and a plurality of tubes 12, 13, 14 telescopically engaging with one another to be extended for opening the umbrella or to be folded into the runner sleeve 11 for closing the umbrella; and a rib assembly 2 pivotally secured to an upper notch 20 formed on a top of the central shaft 1 and pivotally secured to the safety runner 3 which is slidably held on the runner sleeve 11 of the central shaft 1.

As shown in FIG. 1, the central shaft 1, except the runner sleeve 11, comprises the plurality of tubes telescopically engaging with one another, including: an upper tube 12, a middle the 13, and a lower tube 14 which is then secured with a grip or handle 15. Of course, the number of tubes or folds of the central shaft 1 is not limited in this invention. When closing the umbrella, the tubes 12, 13, 14 may be retracted and received into the hollow interior within the runner sleeve 11.

Figure 10:
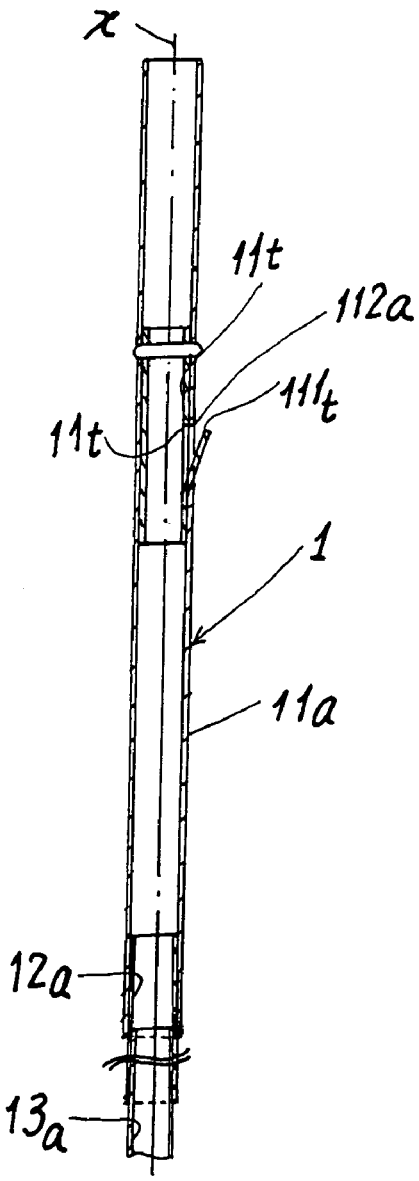
FIG. 10 shows further preferred embodiment of the runner sleeve and the central shaft of the present invention.

Naturally, the runner sleeve 11 may also be formed as a portion or an upper portion of the central shaft 1 to allow the resilient protrusion 111 on the sleeve 11 to be engaged with or disengaged from the runner 3 as slidably held on the runner sleeve 11 for opening or closing the umbrella, which will be described hereinafter with one preferred example (FIG. 10).

The runner sleeve 11 may be integrally formed as an elongate tubular sleeve, or may be fixed on a tube member 11*p* as shown in FIG. 7. A stopper 11*s* is formed on the sleeve 11 for limiting an upward movement of the runner 3 when opening the umbrella as shown in FIG. 1.

Figure 4:
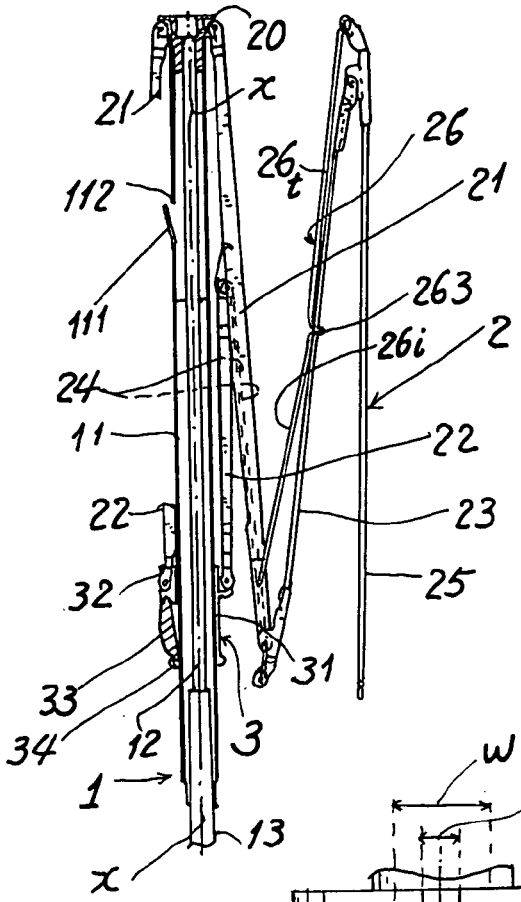
FIG. 4 shows the umbrella of the present invention as closed from FIG. 3.
Figure 5:
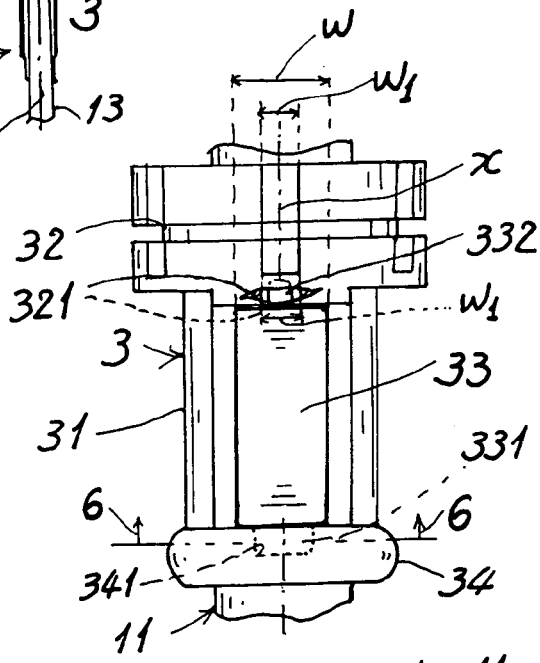
FIG. 5 is a front view illustration of the safety runner of the present invention.
Figure 6:
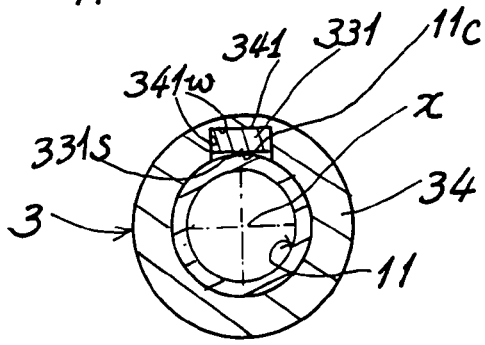
FIG. 6 is a cross-sectional drawing of the runner as viewed from 6-6 direction of FIG. 5.

The number of folds of the umbrella is not limited in accordance with the present invention. For instance, the present invention may be formed as triple-fold as shown in FIGS. 1 and 4.

Figure 9:
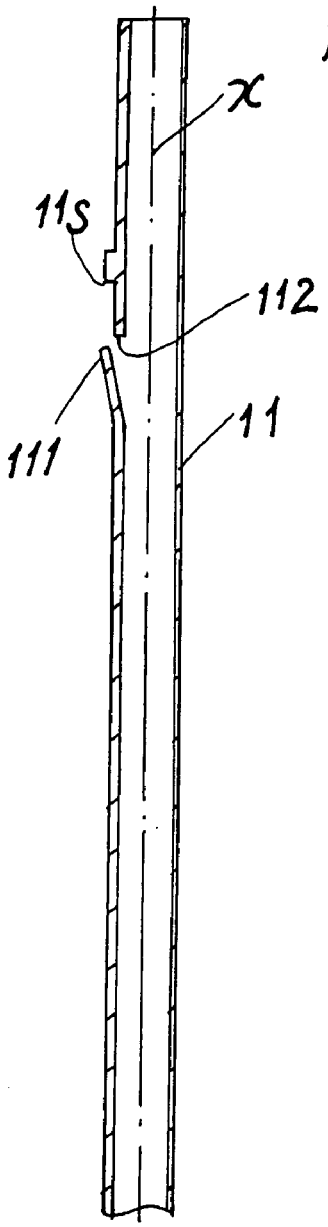
FIG. 9 shows another preferred embodiment of the runner sleeve as modified from FIG. 7.

The runner sleeve 11 may be integrally formed, as shown in FIG. 9, such as by plastic molding process, or by any other suitable processes.

The tubes 12, 13, 14 of the central shaft 1 are gradually increasing the tube diameter from the upper tube 12 to the lower tube 14 as shown in FIG. 1.

Naturally, the tube diameter of the plural tubes 11*a*, 12*a*, 13*a* of the central shaft 1 may also be gradually decreased from the upper one 11*a* to the lower one 13*a* as shown in FIG. 10 which will be further described hereinafter.

The rib assembly 2 as illustrated includes: a top rib 21 pivotally secured to the upper notch 20 formed on a top of the runner sleeve 11 and the central shaft 1, a stretcher rib 22 having its inner portion pivotally secured to the runner 3 and having an outer portion of the stretcher rib 22 pivotally secured to a middle portion of the top rib 21, an intermediate rib 23 having its inner portion pivotally secured to an outer portion of the top rib 21 and having an innermost end of the intermediate rib 23 pivotally secured to the stretcher rib 22 by a connecting rib 24, and a tail rib 25 having its inner portion pivotally secured to the intermediate rib 23 and having an innermost end of the tail rib 25 pivotally secured to the top rib 21 through a spring rib 26.

Namely, the spring rib 26 has its inner end 261 pivotally secured to the top rib 21 and having an outer end 262 of the spring rib 26 pivotally secured to the tail rib 25, with a middle rib portion 263 of the spring rib 26 slidably coupled to the intermediate rib 23 which will be hereinafter described with reference to FIG. 8.

The sleeve 11 may be integrally formed with a resilient protrusion 111 on the sleeve 11 by cutting a slit 112 in the sleeve It along a partial contour of the protrusion 111. The resilient protrusion 111 normally protrudes outwardly from the longitudinal axis X of the central shaft 1 to be engaged with a socket 330 formed in the runner 3 for locking the runner for opening the umbrella (FIGS. 1 and 2). The resilient protrusion 111 may be depressed inwardly when pivotally biased by a push button 33 of the runner 3 for disengaging the runner 3 from the protrusion 111 for closing the umbrella such as shown in FIGS. 3 and 4.

The runner sleeve 11 may be made of plastic material or other suitable materials. The resilient protrusion 111 has its lower or root portion integrally formed on the sleeve 11 and having the upper portion of the protrusion 111 protruding outwardly upwardly to be engaged with the socket 330 formed in the runner 3 when raising the runner 3 to allow the protrusion 111 to be engaged with the socket 330 in the runner 3 in order for opening the umbrella (FIG. 1).

The runner 3 includes: a cylinder portion 31 having a central opening 310 slidably engageable with the sleeve 11, a ferrule 32 formed on an upper portion of the cylinder portion 31 for pivotally securing the stretcher ribs 22 of the rib assembly 2, and a push button 33 insertably and pivotally secured to a bottom rim 34 of the runner 3 and having the socket 330 formed in the runner 3 for engaging the resilient protrusion 111 formed on the sleeve 11 when opening the umbrella.

The ferrule 32 has a central ring 320 formed in the ferrule 32 to be coaxially communicated with the central opening 310 and slidably engageable with the sleeve 11, whereby when raising the runner 3 for opening the umbrella, the central ring 320 will depress the resilient protrusion 111 inwardly to allow the ferrule 32 to pass the protrusion 111 which will then resiliently protrude outwardly to engage with the socket 330 of the runner 3, thereby locking the runner 3 on the protrusion 111 for stably opening the umbrella.

The safety runner 3 includes the push button 33 pivotally or movably secured to the bottom rim 34 of the runner 3 as shown in FIGS. 5, 6, 2 and 3.

The push button 33 includes a pivotal portion 331 (preferably formed as arcuate shape) formed on a bottom (or lower) portion of the push button 33 and insertably secured to a pivotal cavity 341 formed in the bottom rim 34 generally ring shaped or circular shaped of the runner 3; and a limiting projection 332 formed on a top of the push button and slidably movably held in a slot 321 recessed in a lower portion of the ferrule 32 of the runner 3; whereby upon a depression D of the push button 33 to pivotally bias the push button 33 to inwardly depress the resilient protrusion 111 to disengage the socket 330 in the runner 3 from the resilient protrusion 111, the runner 3 will be lowered for closing the umbrella (FIGS. 3, 4).

The pivotal cavity 341 as formed in the bottom rim 34 of the runner 3 may be confined by a main side wall 341*w* in the bottom rim 34 and a "slidable side wall" formed by a cylindrical surface 11*c* of the runner sleeve 11 by slidably contacting an innermost surface 331*s* of the pivotal portion 331 (FIG. 6) of the push button 33 with the cylindrical surface 11*c* of the runner sleeve 11. That is to say that the cylindrical surface 11*c* of the runner sleeve 11 forms the "slidable side wall" of the pivotal cavity 341 in cooperation with the main side wall 341*w* as formed in the bottom rim 34.

By the way, the structure and mechanism for pivotally securing the push button 33 on the runner 3 (especially in the slim rim 34) will only occupy a minimal volume, thereby being beneficial for making a slim safety runner and for making a slim multiple-fold umbrella accordingly.

The push button 33 includes the limiting projection 332 formed on a top of the push button 33 is slidably held in the slot 321 as recessed in the ferrule 32 of the runner 3, with the limiting projection 332 movably limited by a slot wall 321*w* disposed around the slot 321 to prevent from outward releasing (or separation) of the push button 33 from the runner 3 as shown in FIG. 2.

Also, a width W1 of the slot 321 is smaller than a width W of the push button 33 (FIG. 5) to also limit an upward movement or releasing of the push button 33 from the runner 3 so that the push button 33 is pivotally secured in the runner 3 stably and safely.

For closing the umbrella by depressing the push button 33 inwardly (FIG. 2 to FIG. 3), the push button 33 is pivotally moved to pivotally bias the resilient protrusion 111 inwardly (from the inclined position to an upright or vertical position) to therefore disengage the runner 3 from the protrusion 111 very smoothly and ergonomically for easily closing the umbrella.

The push button 33 may be considered as a "lever" having a "fulcrum" located at the pivotal portion 331 and the pivotal cavity 341 in the bottom rim 34 of the runner 3; the "force point" being located at the depression point D on the button; while the "load or weight point" being located at the thrusting point of the button 33 against the upper portion of the protrusion 111.

So, upon biasing of the "lever" (the push button 33), it can be easily pivotally moved to depress the protrusion 111 inwardly in order for closing the umbrella (from FIGS. 1, 2 to FIGS. 3, 4) at a light force to thereby be superior to the prior art requiring a heavier operation and having a larger volume (affecting its miniaturization to be a slim runner and slim umbrella).

As shown in FIG. 8, the spring rib 26 has its middle rib portion 263 formed as a U-shaped loop 263 for slidably coupling the intermediate rib 23 within the U-shaped loop; with the U-shaped loop 263 having an inner bending portion 263*i* connected between the U-shaped loop 263 of the middle rib portion of the spring rib 26 with an inner rib section 26*i* of the spring rib 26, and an outer bending portion 263*t* connected between the U-shaped loop 263 with an outer rib section 26*t* of the spring rib 26; with the inner rib section 26*i* and the outer rib section 26*t* each respectively being projectively aligned with a rib axis Y defined at a longitudinal center of the spring rib 26; and the inner bending portion 263*i* and the outer bending portion 263*t* cooperatively confining an aperture (or gap) 263*p* therebetween and defining a bending-portion axis Z at a center of the aperture 263*p*; with the bending-portion axis Z being projectively separating from the rib axis Y of the spring rib 26 with an acute angle A.

Accordingly, the aperture 263*p* between the two bending portions 263*i*, 263*t* is not parallel to the rib axis Y, indicating that the aperture (or the gap) 263*p* is deviated from the intermediate rib 23 to prevent from decoupling of the intermediate rib 23 from the U-shaped loop 263 of the spring rib 26 during the folding or unfolding operation to thereby ensure a reliable coupling of the spring rib 26 with the intermediate rib 23.

The intermediate rib 23 is not necessary to be formed with any coupling device for coupling the spring rib 26 with the intermediate rib 23. The spring rib 26 is merely formed as a simple U-shaped loop 263 which can then be reliably coupled with the intermediate rib 23. Therefore, the coupling for coupling the spring rib 26 with the intermediate rib 23 is very simple and will also not occupy a big volume, to thereby be beneficial for making a slim rib assembly 2 and also for making a slim multiple-fold umbrella.

As shown in FIG. 10, the runner sleeve 11 (as aforementioned) is modified to be a "built-in" runner sleeve 11*a* including an inner sleeve 11*t* inserted and fixed in a hollow tube member 11*a*, having a resilient protrusion 111*t* cut from an inner aperture 112*t* of the inner sleeve 11*t* and protruding outwardly upwardly through an outer aperture 112*a* cut out in the tube member 11*a* for engaging the safety runner 3 (not shown) as slidably held on the runner sleeve 11*a*, and having a plurality of tubes (12*a*, 13*a*, etc.) of the central shaft 1 telescopically engaging with one another within the hollow tube member of the runner sleeve 11*a*.

The tubes 12*a*, 13*a* within the runner sleeve 11*a* may be gradually decreasing the tube diameter from the upper one to the lower one. The runner sleeve 11*a* may itself form as an uppermost tube of the central shaft 1 or may be formed as an upper portion of the central shaft 1 for receiving the telescopic tubes to be retracted within the upper runner sleeve 11*a* when closing the umbrella.

So, this embodiment (FIG. 10) having the tubes gradually decreasing their tube diameters downwardly is contrary to that as shown in FIG. 1 having the tubes gradually increasing their tube diameters downwardly.

The present invention provides a slim safety runner 3 and a simple runner sleeve 11, 11*a* having a protrusion 111, 111*t* formed on the sleeve for helpfully making a slim multiple-fold umbrella or umbrella. Meanwhile, the simple U-shaped loop 263 of the spring rib 26 may also help simplify and miniaturize the rib assembly 2 in order for making a slim foldable umbrella.

The present invention may be modified without departing from the spirit and scope of the present invention.

We claim:

1. An umbrella comprising:

a central shaft having a runner sleeve formed on said shaft;

a runner having a cylinder portion slidably engaging with said runner sleeve;

a ferrule formed on the cylinder portion for pivotally securing a stretcher rib of a rib assembly which is pivotally secured to an upper notch formed on a top of said runner sleeve and of said central shaft;

a socket formed in said runner and operatively engaged with a resilient protrusion formed on said runner sleeve for opening the umbrella; and a push button insertably pivotally secured to said runner, said push button including a pivotal portion formed on a bottom portion of the push button and insertably secured to a pivotal cavity formed in a bottom rim generally ring shaped of the runner; and a limiting projection formed on a top of the push button and slidably movably held in a slot recessed in a lower portion of the ferrule of the runner; whereby upon a depression of the push button to pivotally bias the push button to inwardly depress the resilient protrusion to disengage the socket in the runner from the resilient protrusion, the runner will be lowered for closing the umbrella.

2. An umbrella according to claim 1, wherein said pivotal cavity as formed in the bottom rim of the runner is confined by a main side wall in the bottom rim of said runner and a slidable side wall formed by a cylindrical surface of the runner sleeve by slidably contacting an innermost surface of the pivotal portion of the push button with the cylindrical surface of the runner sleeve.

3. An umbrella according to claim 1, wherein said runner sleeve includes an inner sleeve inserted and fixed in a hollow tube member, having said resilient protrusion cut from an inner aperture of the inner sleeve and protruding outwardly upwardly through an outer aperture cut out in the hollow tube member for engaging the safety runner as slidably held on the runner sleeve, and having a plurality of tubes of the central shaft telescopically engaging with one another to be received within the hollow tube member of the runner sleeve when closing the umbrella.

4. An umbrella according to claim 3, wherein said runner sleeve itself forms as an uppermost tube of the central shaft for receiving the tubes as telescopically retracted within the runner sleeve when closing the umbrella.

5. An umbrella according to claim 1, wherein said rib assembly includes a spring rib pivotally secured between a top rib pivotally secured to said stretcher rib, and a tail rib; said spring rib has its middle rib portion formed as a U-shaped loop for slidably coupling therein an intermediate rib pivotally secured between said top rib and said tail rib; with the U-shaped loop having an inner bending portion connected between the U-shaped loop of the middle rib portion of the spring rib with an inner rib section of the spring rib, and an outer bending portion connected between the U-shaped loop with an outer rib section of the spring rib; with the inner rib section and the outer rib section each respectively being projectively aligned with a rib axis defined at a longitudinal center of the spring rib; and the inner bending portion and the outer bending portion cooperatively confining an aperture therebetween and defining a bending-portion axis at a center of the aperture; with the bending-portion axis being projectively separating from the rib axis of the spring rib with an acute angle.

6. A multiple-fold umbrella comprising a central shaft having a runner sleeve formed on said central shaft and a resilient protrusion formed on said runner sleeve; a rib assembly respectively pivotally secured to an upper notch formed on a top of said central shaft and pivotally secured to a safety runner slidably held on said runner sleeve; said runner having a socket recessed therein for engaging said resilient protrusion on said runner sleeve when opening the umbrella; and said runner including a push button insertably pivotally secured to said runner; said rib assembly including a spring rib pivotally connected between a top rib and a tail rib, said spring rib having a U-shaped loon formed on a middle rib portion of said spring rib for slidably coupling said U-shaped loop of said spring rib to an intermediate rib pivotally connected between said tail rib and said top rib, and said top rib pivotally secured to a stretcher rib which is pivotally connected to said runner; and said push button including a pivotal portion formed on a bottom portion of the push button and insertably secured to a pivotal cavity formed in a bottom rim generally ring shaped of the runner; and a limiting projection formed on a top of the push button and slidably movably held in a slot recessed in a lower portion of the ferrule of the runner; whereby upon a depression of the push button to pivotally bias the push button to inwardly depress the resilient protrusion to disengage the socket in the runner from the resilient protrusion, the runner will be lowered for closing the umbrella.

* * * * *